US009824528B2

(12) United States Patent
Visser

(10) Patent No.: US 9,824,528 B2
(45) **Date of Patent: *Nov. 21, 2017**

(54) METHOD OF GAMING, A GAMING SYSTEM AND A GAME CONTROLLER

(71) Applicant: Aristocrat Technologies Australia Pty Limited, North Ryde (AU)

(72) Inventor: Antoon Visser, Coogee (AU)

(73) Assignee: Aristocrat Technologies Australia Pty Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/269,347

(22) Filed: Sep. 19, 2016

(65) Prior Publication Data

US 2017/0004675 A1 Jan. 5, 2017

Related U.S. Application Data

(63) Continuation of application No. 13/427,597, filed on Mar. 22, 2012, now Pat. No. 9,449,459.

(30) Foreign Application Priority Data

Mar. 24, 2011 (AU) ..... 2011901092

(51) Int. Cl.
*G07F 17/34* (2006.01)
*G07F 17/32* (2006.01)

(52) U.S. Cl.
CPC ..... *G07F 17/3213* (2013.01); *G07F 17/3209* (2013.01); *G07F 17/3225* (2013.01); (Continued)

(58) Field of Classification Search
None
See application file for complete search history.

(56) References Cited

U.S. PATENT DOCUMENTS 3,951,411 A 4/1976 Hill et al.
4,296,928 A 10/1981 Nick
(Continued)

FOREIGN PATENT DOCUMENTS

EP 0665036 B1 11/1998
EP 1365367 A2 1/2007
(Continued)

*Primary Examiner* — Tramar Harper
(74) *Attorney, Agent, or Firm* — McAndrews, Held & Malloy, Ltd.

(57) ABSTRACT

A computer implemented method of gaming. The method includes monitoring game outcomes generated for one or more players of a plurality of linked gaming machines, and for each generated game outcome i) identifying instances of one or more special symbols occurring in the generated game outcome, ii) incrementing an accumulating counter for each of the one or more special symbols based on instances of one or more special symbols occurring in the game outcome, and iii) determining whether a trigger condition is met. In response to the trigger condition being met, allocating one or more special symbols to one or more of the linked gaming machines for modifying a game outcome generated for a player of the linked gaming machine, to provide a new game outcome for each of the one or more players of linked gaming machines to which the special symbols are allocated, wherein the number of special symbols allocated to the linked gaming machines is based on a value of the accumulating counter for the special symbol at the time the trigger condition was met, and resetting the accumulating counter for the allocated special symbols.

24 Claims, 7 Drawing Sheets

(52) U.S. Cl.
CPC ..... *G07F 17/3246* (2013.01); *G07F 17/3267* (2013.01); *G07F 17/3272* (2013.01); *G07F 17/34* (2013.01)

(56) References Cited

U.S. PATENT DOCUMENTS 4,913,446 A 4/1990 Winkelman
4,984,806 A 1/1991 Alfred
5,102,143 A 4/1992 Winkelman
5,431,408 A * 7/1995 Adams ..... A63F 1/00 273/292
5,641,166 A 6/1997 Reisel
5,791,650 A 8/1998 Pardee
5,980,384 A 11/1999 Barrie
5,997,401 A * 12/1999 Crawford ..... G07F 17/3265 273/143 R
6,012,982 A 1/2000 Piechowiak et al.
6,062,562 A 5/2000 Pardee
6,089,980 A * 7/2000 Gauselmann ..... G07F 17/3211 463/25
6,120,029 A 9/2000 Carmichael et al.
6,168,523 B1 1/2001 Piechowiak et al.
6,616,531 B1 9/2003 Mullins
6,645,073 B2 11/2003 Lemay et al.
6,726,563 B1 4/2004 Baerlocher et al.
6,731,313 B1 5/2004 Kaminkow
6,984,173 B1 1/2006 Piechowiak et al.
7,223,172 B2 5/2007 Baerlocher et al.
7,234,701 B2 6/2007 Hungerford
7,311,598 B2 12/2007 Kaminkow et al.
7,311,604 B2 12/2007 Kaminkow et al.
7,419,430 B1 9/2008 Joshi et al.
7,427,236 B2 9/2008 Kaminkow et al.
7,448,628 B2 11/2008 Pedersen
7,448,949 B2 11/2008 Kaminkow et al.
7,478,811 B2 1/2009 Johnson
7,507,154 B1 3/2009 D'Avanzo
7,526,736 B2 4/2009 Kaminkow et al.
9,449,459 B2 9/2016 Visser
2002/0010018 A1 1/2002 Lemay et al.
2003/0073483 A1* 4/2003 Glavich ..... G07F 17/32 463/20
2003/0190943 A1* 10/2003 Walker ..... G07F 17/32 463/17
2003/0216165 A1* 11/2003 Singer ..... G07F 17/34 463/20
2004/0092300 A1* 5/2004 Gauselmann ..... G07F 17/32 463/16
2004/0121833 A1* 6/2004 Mezen ..... G07F 17/32 463/16
2004/0166929 A1 8/2004 Tarantino
2004/0171416 A1 9/2004 Baerlocher et al.
2004/0171420 A1 9/2004 Baerlocher et al.
2004/0198489 A1 10/2004 Kaminkow et al.
2004/0224746 A1 11/2004 Fong
2004/0266508 A1 12/2004 D'Avanzo
2005/0116417 A1 6/2005 Soltys et al.
2005/0208992 A1 9/2005 Randall
2006/0009280 A1 1/2006 Joshi et al.
2006/0019739 A1 1/2006 Soltys et al.
2006/0022470 A1 2/2006 Johnson
2006/0046021 A1 3/2006 Morris
2006/0046821 A1 3/2006 Kaminkow et al.
2006/0046822 A1 3/2006 Kaminkow et al.
2006/0046823 A1 3/2006 Kaminkow et al.
2006/0068872 A1* 3/2006 Walker ..... G07F 17/32 463/13
2006/0068893 A1* 3/2006 Jaffe ..... G07F 17/34 463/20
2006/0071428 A1 4/2006 Hungerford
2006/0142080 A1 6/2006 Enzminger
2006/0264257 A1 11/2006 Jaffe et al.
2007/0024527 A1 2/2007 Heikkinen et al.
2007/0149292 A1 6/2007 Kaminkow et al.
2007/0213119 A1 9/2007 Baerlocher et al.
2007/0218982 A1 9/2007 Baerlocher
2007/0235930 A1 10/2007 Pedersen
2007/0281783 A1 12/2007 O'Halloran et al.
2008/0020817 A1 1/2008 Kaminkow et al.
2008/0020842 A1 1/2008 Kaminkow et al.
2008/0026832 A1* 1/2008 Stevens ..... G07F 17/32 463/26
2008/0039191 A1 2/2008 Cuddy
2008/0045309 A1 2/2008 Okada
2008/0051168 A1 2/2008 Kaminkow et al.
2008/0058078 A1* 3/2008 Fong ..... G07F 17/3258 463/20
2008/0070702 A1 3/2008 Kaminkow et al.
2008/0161081 A1 7/2008 Berman
2008/0182653 A1 7/2008 O'Halloran et al.
2008/0227526 A1 9/2008 Crossman et al.
2008/0248862 A1 10/2008 Joshi et al.
2008/0311979 A1 12/2008 Walker et al.
2009/0011822 A1 1/2009 Englman et al.
2009/0011823 A1 1/2009 Englman et al.
2009/0011824 A1 1/2009 Englman et al.
2009/0075722 A1* 3/2009 Louie ..... G07F 17/32 463/20
2009/0117979 A1* 5/2009 Decasa, Jr. ..... G07F 17/32 463/20
2009/0124325 A1 5/2009 Wadleigh et al.
2009/0124364 A1* 5/2009 Cuddy ..... G07F 17/3258 463/27
2009/0149237 A1 6/2009 Solaja et al.
2009/0176551 A1* 7/2009 Wilson ..... G07F 17/32 463/20
2009/0253488 A1 10/2009 Yoshizawa
2009/0295714 A1 12/2009 Erickson
2012/0231868 A1* 9/2012 Guinn ..... G07F 17/34 463/20

FOREIGN PATENT DOCUMENTS

WO 9815928 4/1998
WO 0119475 3/2001
WO 03047708 A1 6/2003
WO 2005002691 A2 1/2005
WO 2005002691 A3 1/2005
WO 2005011826 A1 2/2005
WO 2005086018 A1 9/2005
WO 2005104049 11/2005
WO 2006028740 A2 3/2006
WO 2006041721 A2 4/2006
WO 2006041721 A3 4/2006
WO 2007103054 A2 9/2007
WO 2007106659 A2 9/2007
WO 2006028740 A3 12/2007
WO 2007103054 A3 6/2008
WO 2007106659 A3 11/2008
WO 2008141378 A1 11/2008
WO 2009105539 8/2009

* cited by examiner

METHOD OF GAMING, A GAMING SYSTEM AND A GAME CONTROLLER

RELATED APPLICATIONS

This application is a continuation of U.S. patent application Ser. No. 13/427,597 filed Mar. 22, 2012 which claims priority to Australian Patent Application No. 2011901092, having a filing date of Mar. 24, 2011, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a method of gaming, a gaming system and a game controller.

It is known to provide a gaming system including a gaming controller arranged to randomly select symbols for display from a predetermined set of symbols and determine a game outcome based on the displayed symbols. It is also known to include special symbols, for example WILD symbols, in a symbol set for additional interest.

While such gaming systems provide players with enjoyment, a need exists for alternative gaming systems in order to maintain or increase player enjoyment.

BRIEF SUMMARY OF THE INVENTION

In an aspect, the invention provides a computer implemented method of gaming comprising the steps of:

monitoring game outcomes generated for one or more players of a plurality of linked gaming machines and for each generated game outcome performing the steps of:

identifying instances of one or more special symbols occurring in the generated game outcome;

incrementing an accumulating counter for each of the one or more special symbols based on instances of one or more special symbols occurring in the game outcome; and determining whether a trigger condition is met;

and, in response to the trigger condition being met performing the steps of:

allocating one or more special symbols to one or more of the linked gaming machines for modifying a game outcome generated for a player of the linked gaming machine, to provide a new game outcome for each of the one or more players of linked gaming machines to which the special symbols are allocated, wherein the number of special symbols allocated to the linked gaming machines is based on a value of the accumulating counter for the special symbol at the time the trigger condition was met; and resetting the accumulating counter for the allocated special symbols.

In another aspect, the invention provides a linked game controller comprising:

a game outcome monitor adapted to monitor game outcomes generated for one or more players of a plurality of linked gaming machines and identifying instances of one or more special symbols occurring in the generated game outcomes;

a special symbol controller adapted to increment an accumulating counter for each of one or more special symbols based on instances of the one or more special symbols occurring, and in response to a trigger condition being met, allocate to one or more linked gaming machines, based on a value of the accumulating counter for each special symbol, special symbols to modify a game outcome generated for a player of each linked gaming machine to which the special symbols are allocated to provide a new game outcome for the player, and reset the accumulating counter for each of the one or more special symbols allocated; and a trigger monitor adapted to determine when a trigger condition is met.

In another aspect, the invention provides a gaming system comprising:

a plurality of linked gaming machines in data communication with a game controller via a gaming network; and a game controller comprising:

a game outcome monitor adapted to monitor game outcomes generated for one or more players of a plurality of linked gaming machines and identifying instances of one or more special symbols occurring in the generated game outcomes;

a special symbol controller adapted to increment an accumulating counter for each of one or more special symbols based on instances of the one or more special symbols occurring, and in response to a trigger condition being met, allocate to one or more linked gaming machines, based on a value of the accumulating counter for each special symbol, special symbols to modify a game outcome generated for a player of each linked gaming machine to which the special symbols are allocated to provide a new game outcome for the player, and reset the accumulating counter for each of the one or more special symbols allocated; and a trigger monitor adapted to determine when a trigger condition is met.

In some embodiments the trigger condition based on outcomes generated for one or more of the linked gaming machines.

In an embodiment the trigger condition is met by the occurrence of one or more specified symbol combinations in the game outcomes generated for one or more of the linked gaming machines.

In an embodiment the trigger condition is met by the occurrence of a first specified symbol combination in a game outcome generated for at least one of the linked gaming machines and a second specified symbol combination in a game outcome generated for at least one of the linked gaming machines other than the linked gaming machines for which the first specified symbol combination occurs.

The trigger condition can be independent of the generated game outcomes.

In an embodiment the trigger condition is based on a random result.

The trigger condition is based on the value of an accumulating counter for a special symbol and the number of eligible linked gaming machines being played.

In an embodiment the number of each of the special symbols allocated for modifying the game outcomes is limited to a value of an accumulating counter for the special symbol.

In an embodiment at least one special symbol is allocated to each eligible linked gaming machine being played for modifying game outcomes.

The number special symbols allocated for modifying the game outcomes can be a multiple of the number of eligible linked gaming machines being played.

In another embodiment the number of special symbols allocated can be equal to a value of the accumulating counter for the special symbol at the time the trigger condition is met and the special symbols are allocated to eligible gaming machines for modifying game outcomes based on game rules.

The special symbols can be unevenly allocated to the eligible linked gaming machines.

In one embodiment the linked gaming controller can include an outcome modifier adapted to modify the game outcome for each of the eligible linked gaming machines being played based on special symbol instances allocated to the linked gaming machine.

In an alternative embodiment each linked gaming machine includes an outcome modifier adapted to modify the game outcome for the linked gaming machine based on special symbols allocated to the linked gaming machine.

The one or more of the linked gaming machines can be allocated one or more special symbols for modifying a game outcome generated are selected based on eligibility criteria.

The system can further comprise a prize evaluator adapted to determine an award payable to the player of each linked gaming machine being played based on the new game outcome for each player.

In another aspect, the invention provides computer program code which when executed implements the above method.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
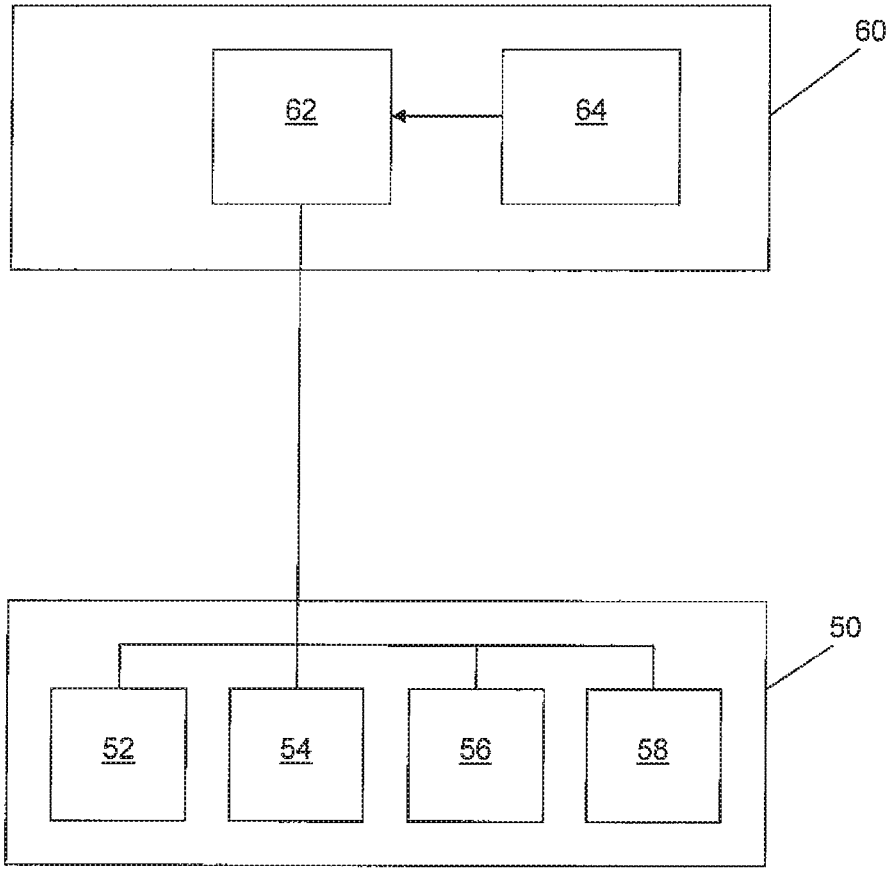
FIG. 1 is a block diagram of the core components of a gaming system.

Referring to the drawings, there is shown a gaming system having a linked game controller arranged to implement a game wherein game outcomes generated for one or more players of a plurality of linked gaming machines are monitored and instances of one or more special symbols occurring in the generated game outcomes are identified. Accumulating counters are incremented based on instances of the special symbols occurring in game outcomes generated for the linked gaming machines until a trigger condition is met. In response to the trigger condition being met, special symbols are allocated to one or more of the linked gaming machines for modifying a game outcome generated for players of the linked gaming machines using the allocated special symbols to provide a new game outcome for each of the players. The new game outcome for each player can be evaluated to determine any award for the new game outcome. Any award may be may be payed to each player as a bonus prize.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
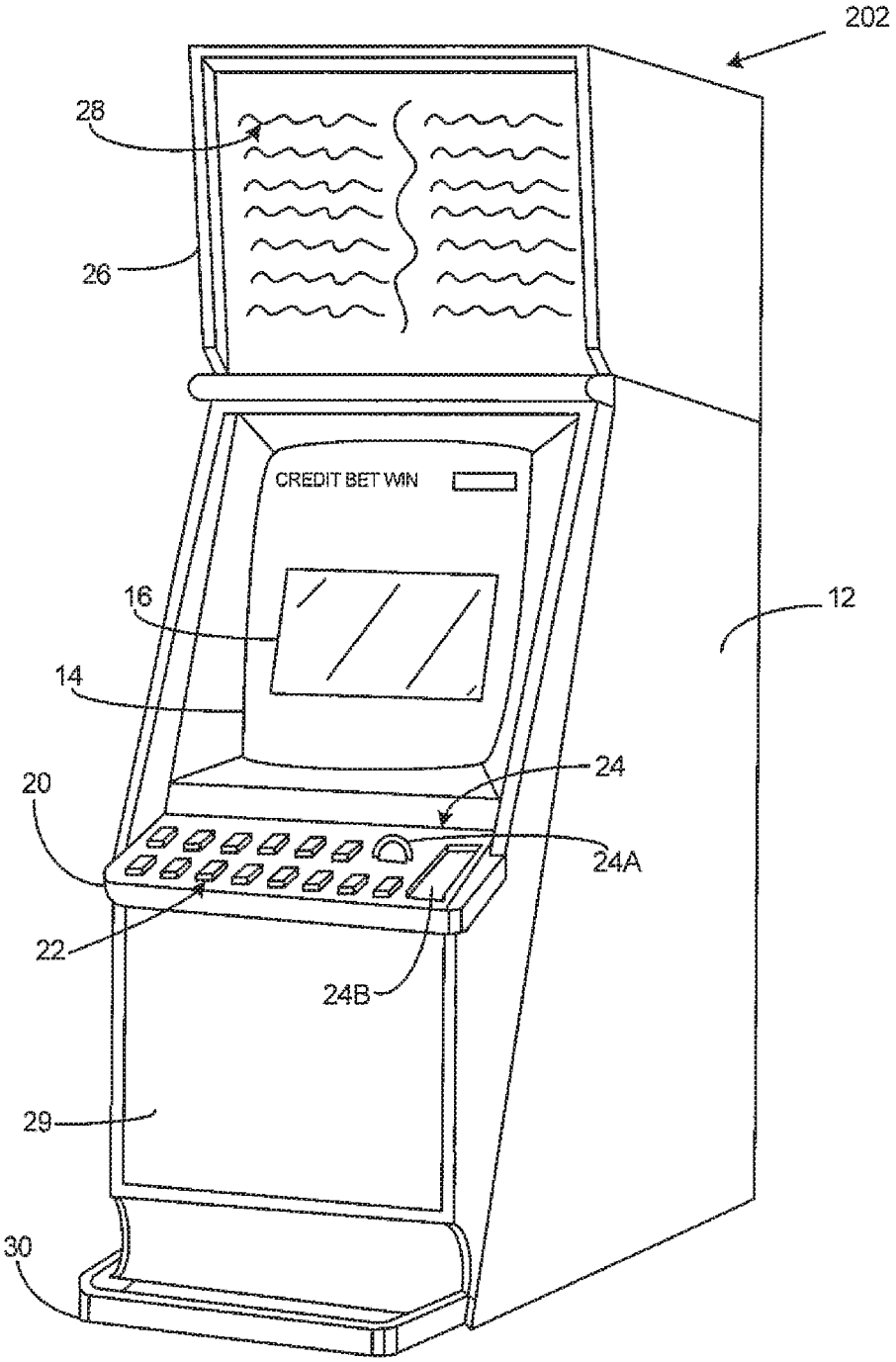
FIG. 2 is a perspective view of a stand alone gaming machine.

A gaming system in the form of a stand alone gaming machine 202 is illustrated in FIG. 2. The gaming machine 202 includes a console 12 having a display 14 on which are displayed representations of a game 16 that can be played by a player. A mid-trim 20 of the gaming machine 202 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 202.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
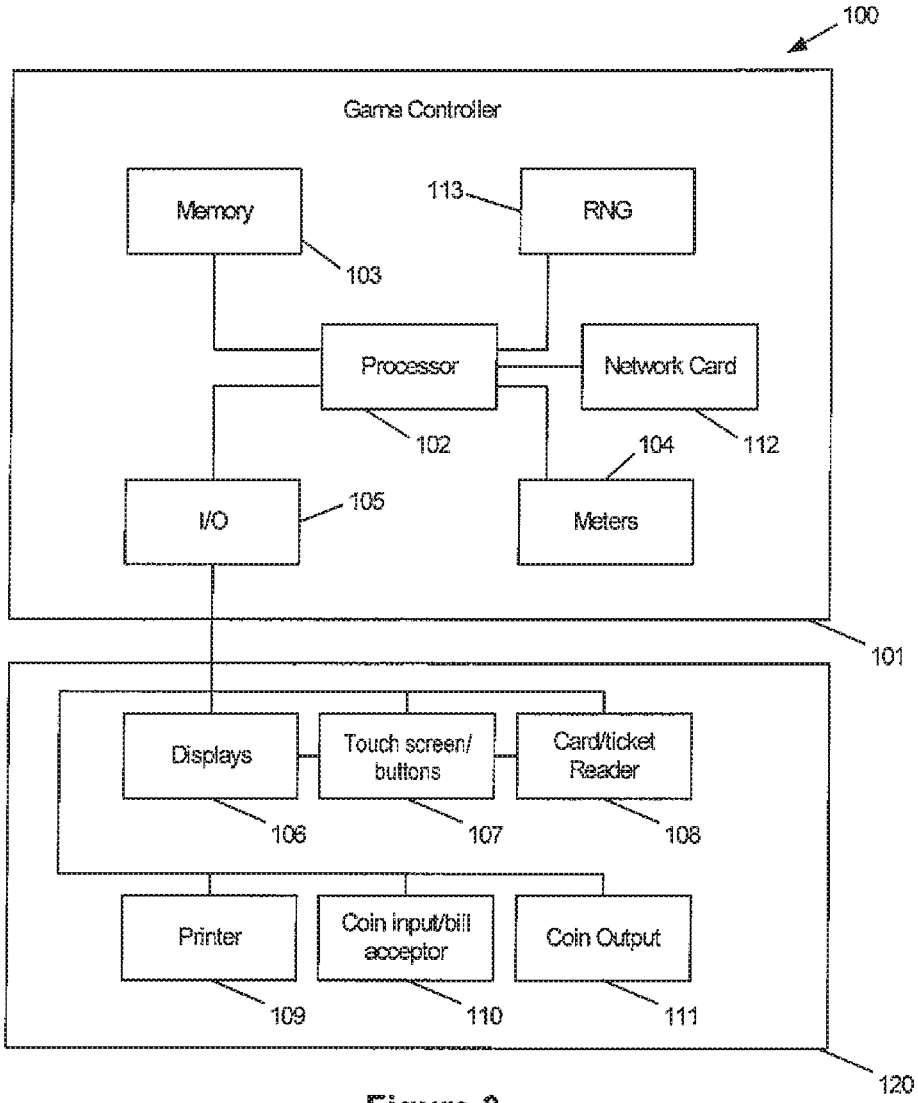
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
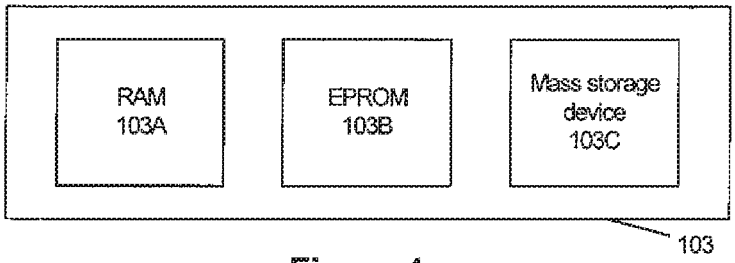
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
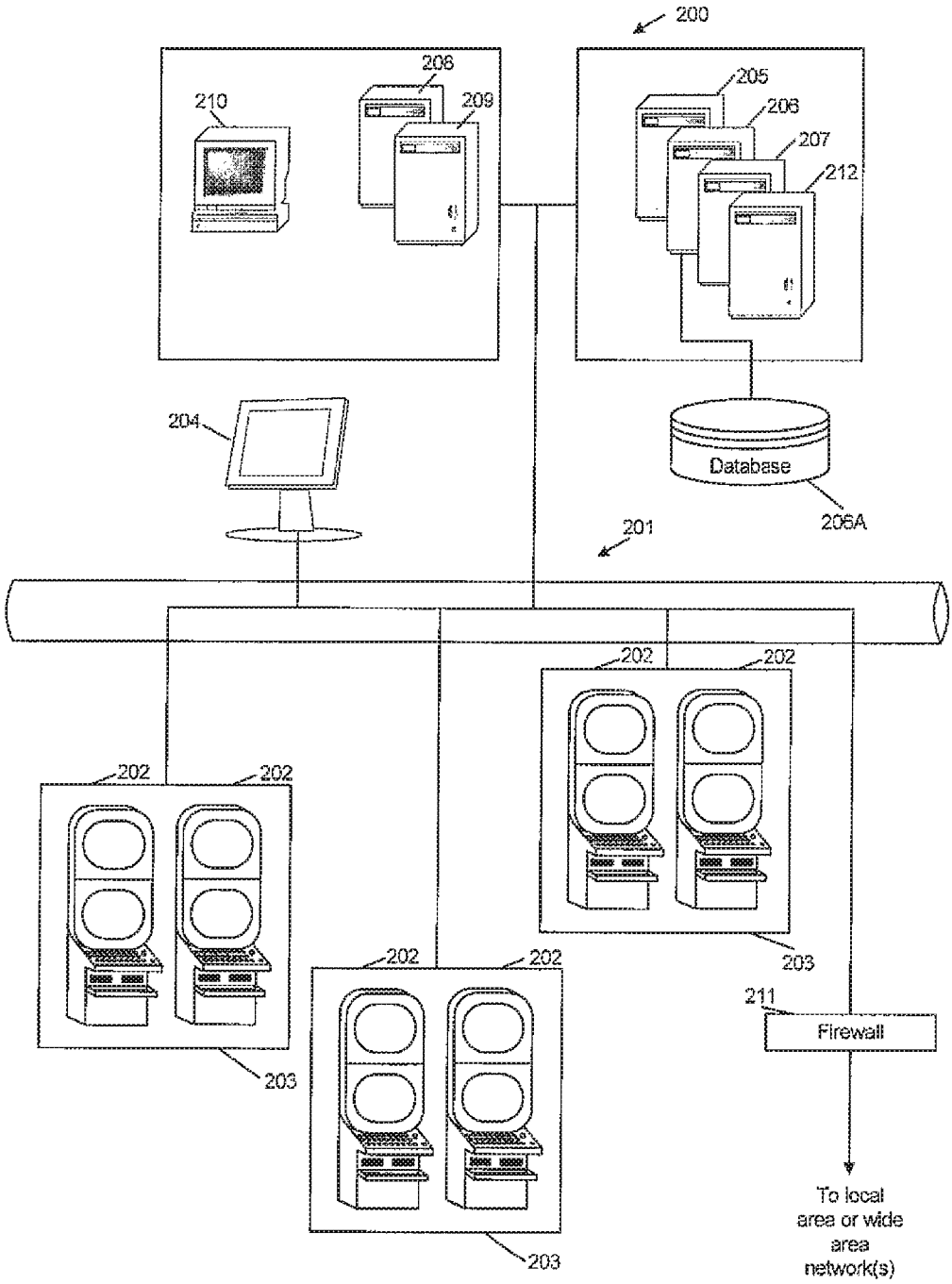
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 202,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller.

A database management server 206 may manage storage of game programs and associated data for downloading or access by the gaming devices 202 in a database 206A.

Typically, if the gaming system enables players to participate in a Jackpot game, a Jackpot server 207 will be provided to perform accounting functions for the Jackpot game. In some embodiments the jackpot server 207 may be substituted by a Bonus server adapted to control bonus functions applied across a group of gaming machines. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Embodiments of the present invention game outcomes generated for one or more players of a plurality of linked gaming machines are monitored. Instances of one or more special symbols occurring in the generated game outcomes are counted and accumulating counters incremented for each of the one or more special symbols until a trigger condition is met. In response to the trigger condition being met, one or more special symbols are allocated to one or more of the linked gaming machines. A game outcome generated for one or more of the players of the linked gaming machines can be modified using the allocated special symbols to provide a new game outcome for the player. The new game outcome for each player can be evaluated to determine any award for the new game outcome. Any award may be may be payed to each player as a bonus prize.

Figure 6:
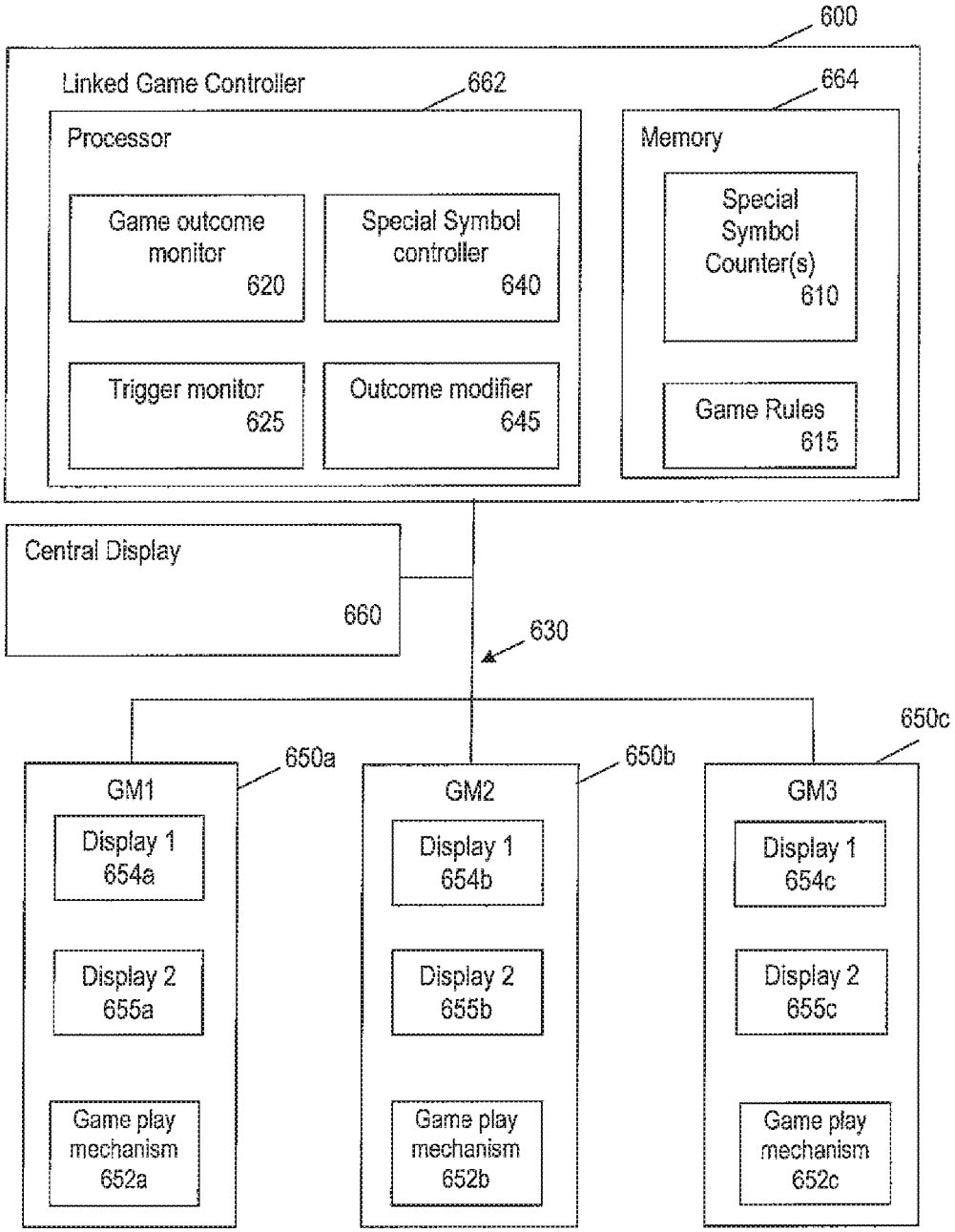
FIG. 6 is a further block diagram of a gaming system.

FIG. 6 shows an embodiment of the gaming system comprising a linked game controller 600 and a plurality of linked gaming machines 650*a-c* in data communication with the game controller 600 via a gaming network 630. Each of the gaming machines has a game play mechanism 652*a-c*, a display for displaying game outcomes 655*a-c* of a base game and an additional display 654*a-c* for displaying additional information, for example game play instructions, loyalty information, or bonus information. Each of the gaming machines 650*a-c* can be a stand alone gaming machine including all the functionality required to generate game outcomes for a base game. Alternatively each gaming machine may be a client of a gaming server having a base game controller for generating game outcomes. Examples of base games include spinning reel games, dice games, card games etc. The outcome of the base game is a set of symbols and awards for the base game are determined based on combinations of symbols occurring in the game outcome.

The gaming machines are adapted to communicate with the linked game controller 600 to link the gaming machines for the purpose of participation in a bonus scheme. In the embodiment of FIG. 6 the linked game controller controls bonus functions only. The bonus functions are independent of the operation of the base game controlled by the gaming machines or a base game server and therefore cannot influence play of base game. Each gaming machine provides the same game for play by the players.

In FIG. 6, the processor 662 of linked game controller 600 is shown implementing a number of modules based on program code and data stored in memory 664. Persons skilled in the art will appreciate that various of the modules could be implemented in some other way, for example by a dedicated circuit. These modules include a game outcome monitor 620, special symbol controller 640, trigger monitor 625 and optional outcome modifier 645. In some embodiments the base game controllers of the gaming machines or base game server may be adapted to modify the game outcomes. Game rules 615 and one or more accumulating special symbol counters 610 are also stored in memory 664. A central display 660 can also be provided for display of the progress of the linked game, for example, based on values of accumulating counters or progress for trigger conditions.

The game outcome monitor 620 is adapted to monitor the game outcomes generated by each of the linked gaming machines 650*a-c*. The game outcomes are generated in response to game play instructions input to the gaming machines 650*a-c* by their respective players. The game outcome monitor 620 identifies instances of one or more special symbols in the base game outcomes. For example the special symbols may be WILD, DOUBLE PAY, SCATTER PAY or any specified symbol that may occur in the game outcomes.

The special symbol controller 640 counts instances of each special symbol occurring in a game outcome and updated accumulating counters 610 for each different special symbol. In response to the trigger condition being met, the special symbol controller is also adapted to control allocation of instances of the special symbols to modify a game outcomes generated for one or more players of the linked gaming machines to provide a new game outcome for each of the one or more players.

For example, the special symbols for this example are WILD symbols that may substitute for any other symbol of a game outcome to make up a winning symbol combination. The game outcome monitor 620 monitors game outcomes generated by each of the gaming machines to identify any WILD symbols occurring in the game outcomes. When a WILD symbol is identified, the game outcome monitor 620 indicates this to the special symbol 640 controller and the special symbol controller counts this instance of the WILD symbol in memory 664, for example, by updating an accumulating counter 610. The special symbol controller may also be adapted to display the accumulated special symbols to the players. For example, the special symbol controller may include a display controller adapted to display images of a set of "captured" WILD symbols on a central display 660 or the additional display 654*a-c* on each gaming machine. One captured WILD symbol may be displayed for each counted instance of a WILD symbol counted in the accumulating counter. Thus player can watch the WILD symbols accumulate. However, other graphic images such as an incrementing counter, filling vessel etc. may be used.

The special symbol controller 640 also controls allocation of special symbols to modify game outcomes for one or more of the gaming machines 650*a-c* being played to provide new game outcomes. The special symbol controller allocates the special symbols in accordance with game rules, based on the value of the accumulating special symbol counter. The accumulating counter is reset after each allocation of special symbols.

The special symbols are allocated in response to a trigger condition being met. For example, the trigger condition may be occurrence of a specified symbol or combination of symbols in one or more game outcomes generated by the gaming machines 650*a-c* for the base game. The trigger monitor 625 monitors occurrence of the trigger condition. In some embodiments the trigger monitor 625 functionality may be implemented in the outcome monitor 620. When the specified symbol combination occurs, the trigger condition is indicated to the special symbol controller 640, for example by setting a flag or sending a signal.

In an embodiment the trigger condition is two different predefined symbol combinations occurring simultaneously in two game outcomes generated for two different linked gaming machines. For example, the trigger combinations may be three ACE symbols occurring in one game outcome and three KING symbols occurring at the same time in another game outcome. In some embodiments the game outcomes having the winning combinations may not have to be generated at exactly the same time but may be required to both be on display for the players at the same time. Alternatively the two symbol combinations must occur in two different game outcome occurring within a given time window. For example, occurrence of the first symbol combination of may start a time window of twenty seconds for the second symbol combination to occur. To add to players enjoyment the first symbol combination occurring may be advertised to all players, say on secondary displays 654*a-c* or on a central display, and a countdown timer may be displayed to show the time limit for the second symbol combination to occur to trigger the bonus feature.

Alternatively the trigger condition can be independent of the base game. For example, the trigger condition may be a threshold number of instances of special symbols being recorded. The threshold may be based on the number of linked machines being played. Alternatively the threshold number may be set by the special symbol controller. For example, the threshold number may be based on a predetermined set of thresholds. The threshold used may be selected based on a random process or may be based on other criteria, such as the amounts being bet by players of the gaming machines or time since the last trigger. In another embodiment, triggering can be based on a random process, for example generation of a random or pseudo random number. In another alternative example the trigger may be based on a timer.

In another embodiment the trigger condition is based on the number of recorded instances of the special symbol and the number of linked gaming machines being played. The trigger condition may be set to a multiple of the number of gaming machines being played. For example, trigger condition may be may be the number of special symbols recorded equalling two times the number of gaming machines being played. Alternatively the trigger may be a threshold number set based on the number of machines being played. For example, where ten gaming machines are linked, the trigger condition may be a threshold of fifteen special symbols while six or less gaming machines are being played and twenty when all ten gaming machines are being played. If the number of players changes, the threshold can be altered accordingly. A number of thresholds and player criteria can be defined in game rules 615.

It should be appreciated that these are just a few examples of triggering and many other alternatives could be used with the system of the present of the invention.

When the trigger condition is met, the trigger is indicated to the special symbol controller 640, for example by setting a flag or sending a signal.

The special symbol controller 640 allocates instances of the special symbol to one or more of the gaming machines in accordance with game rule 615, to be used to modify a game outcome generated for the base game to provide a new game outcome. The manner in which the special symbols are allocated to gaming machines is based on game rules and many embodiments are envisaged.

In a first embodiment the number of instances of special symbols allocated to gaming machines is limited to a value of the accumulating counter for the special symbol. For example, where ten gaming machines are being played and the trigger condition is met but only five instances of the special symbol have been accumulated, special symbols can only be allocated to five or less of the played gaming machines. The gaming machines are selected based on game rules. For example, the gaming machines selected may include those that contributed to the trigger condition being met, randomly selected, or selected based on which game outcomes may benefit from the special symbol to produce winning outcomes. In another embodiment the selected gaming machines are those meeting eligibility criteria for allocation of special symbols. Examples of eligibility criteria include duration played, player loyalty program status, cumulative bet amounts etc.

In a second embodiment at least one special symbol is allocated to each linked gaming machine being played for modifying game outcomes. For example, where ten gaming machines are being played and the trigger condition is met but only five instances of the special symbol have been counted, one special symbol will be allocated for each of the linked gaming machines being played. Any prize awarded for winning outcomes may be calculated taking into consideration the additional special symbols allocated. For example, the total award payable for the bonus may be based on the number of special symbol instances counted, rather than the number of special symbols allocated. In another example, where ten gaming machines are being played and thirteen special symbol instances counted, ten may be allocated to the gaming machines leaving the remaining three recorded to await the next trigger or removed. Awards allocated can be based on the total number of symbols recorded or on the number of symbols released depending on the embodiment implemented.

The number of special symbols allocated for modifying the game outcomes can be a multiple of the number of eligible linked gaming machines being played. For example, where ten machines are being played and twenty symbol instances have been counted, two special symbols can be allocated to each gaming machine.

In another embodiment the number of special symbols allocated to the gaming machines being played is equal to the number accumulated. The special symbols can be allocated to the gaming machines for modifying game outcomes based on game rules. For example, twenty four instanced of the special symbol may be counted and fifteen gaming machines are being played and eligible for the bonus special symbol allocation when the trigger condition is met. The special symbols can be unevenly allocated to the eligible linked gaming machines. For example, one special symbol may be allocated to each gaming machine and the remaining nine special symbols randomly allocated to nine gaming machines. Alternatively the special symbols may be allocated randomly across all fifteen gaming machines, say with any one gaming machine allocated between zero and three special symbols.

An outcome modifier 645 is provided to modify the game outcomes in accordance with game rules. The outcome modifier can be implemented in the game controller 600. This has an advantage of the processing of the bonus feature being separated from the execution of the base game. Which, in turn, can have advantages of simplifying modification of the bonus feature, and the bonus feature to obtain regulatory approval independent from the base game and gaming machines.

Alternatively, an outcome modifier subroutine may execute in each of the linked gaming machines 650*a-c*.

Modification of the game outcomes is performed in accordance with game rules and may vary depending on the embodiment implemented. For example, if a WILD symbol is allocated to a gaming machine 650*a* then the last game outcome generated for the base game can be used for the bonus game. Alternatively the WILD can be used to modify the next game outcome generated. The WILD symbol can be substituted for any other symbol in the game outcome. In an embodiment the outcome modifier 645 is adapted to substitute the WILD symbol for another symbol to make a winning combination, if possible, in the new game outcome. If more than one winning combination may be made then the winning combination have a higher award can be selected. Where more than one WILD symbol may be allocated symbols may be substituted in a manner that enables the most wining combinations to occur. Alternatively the player my be allowed to choose where the WILD symbols are placed, adding an element of skill to the game.

Awards payable to the player of each linked gaming machine being played are determined based on the new game outcome for each player. The award for the new game outcome can be payed as a bonus award.

Figure 7:
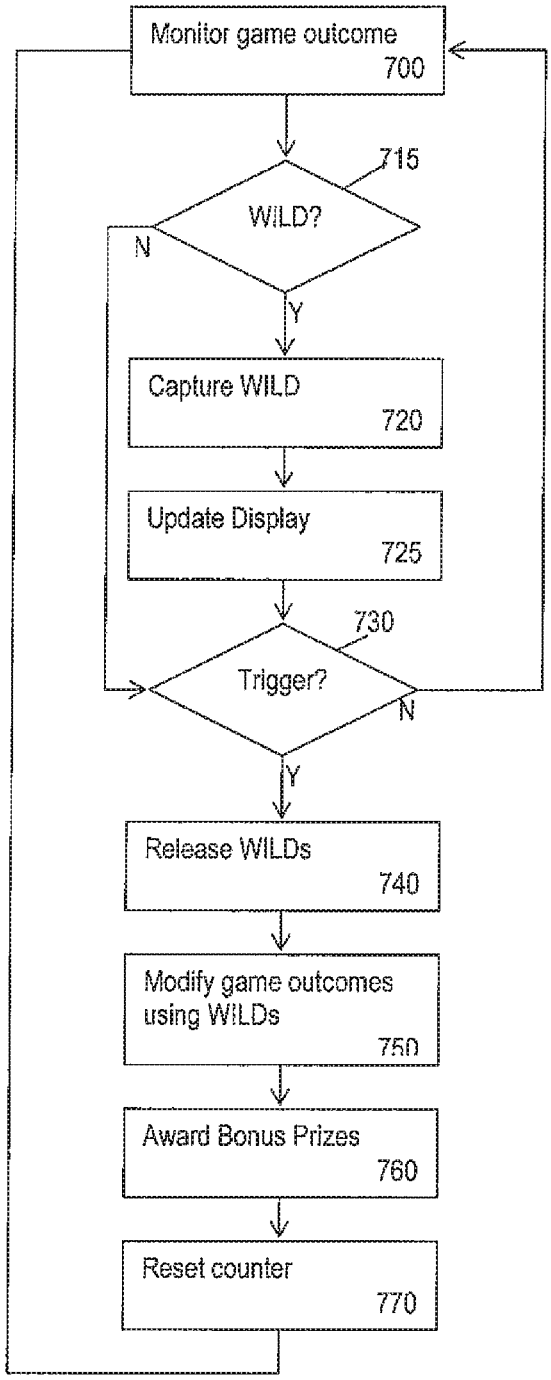
FIG. 7 is a flow chart of an embodiment.
Figure 8:
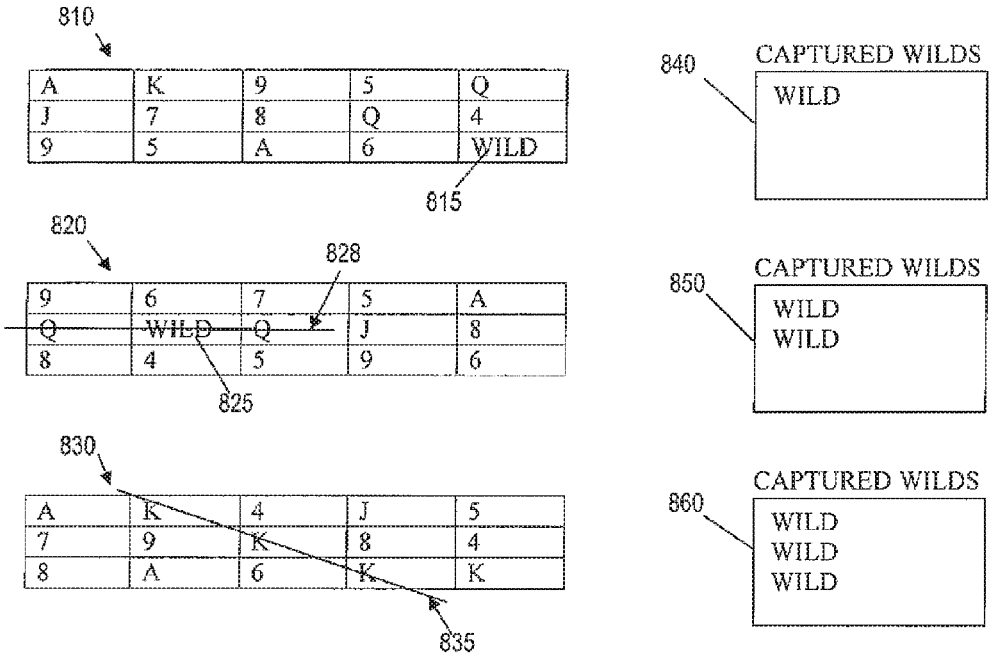
FIG. 8 is an example of game outcomes displayed during game play.

An example of a game play process will be described with reference to the flowchart of FIG. 7 and the examples of displayed game outcomes of FIGS. 8 and 9.

The game outcomes generated for each gaming machine are monitored 700 to identify and count any special symbols, in this example WILD symbols, occurring the game outcome 710. FIG. 8 shows three game outcomes 810, 820, 830 generated for three different gaming machines. A second display 840 displays "Captured WILDS" so players can see how many WILD symbols have been captured. In the example of FIG. 8 one WILD symbol has already been captured before the sequence discussed begins. The game outcomes are monitored in the order they are generated and the timing of the game outcomes being generated is based on when the player inputs game play instructions. Outcome 810 is the first generated. This outcome includes one WILD symbol 815 and no winning symbol combinations. The instance of the WILD symbol occurring is counted 720, by updating an accumulating counter, and displayed 725 in the "Captured WILDS" 850. It is then determined whether or not the trigger condition is met 730. In this example the trigger condition is a win line of three or more "K" symbols occurring in a game outcome. The trigger condition is not met in game outcome 810, so the procedure returns to the start 700 for the next monitored game outcome 700.

The next game outcome 820 includes one WILD symbol 825 which contributes to a winning symbol combination of three Q symbols. The counter is updated based on the occurrence of the WILD symbol 720 and the display 860 updated 725. The trigger condition is not met so processing continues to the start 700 for the next game outcome 830. The game outcome 830 includes no WILD symbols 710 so processing skips to checking for the trigger condition 730. The trigger condition of three K symbols in a single pay line 835 is met in the game outcome 830. This triggers "release" of the captured WILD symbols 740. In this embodiment one WILD symbol is allocated to each of the gaming machines to modify each of the game outcomes 810, 820, 830 to provide new game outcomes 750 for which bonus prizes can be awarded 760. The counter for the accumulated WILD symbols is reset 770 to zero. In an embodiment where not all the captured WILDS are released the counter can be decremented by the number of symbols allocated, rather than being reset to zero.

Figure 9:
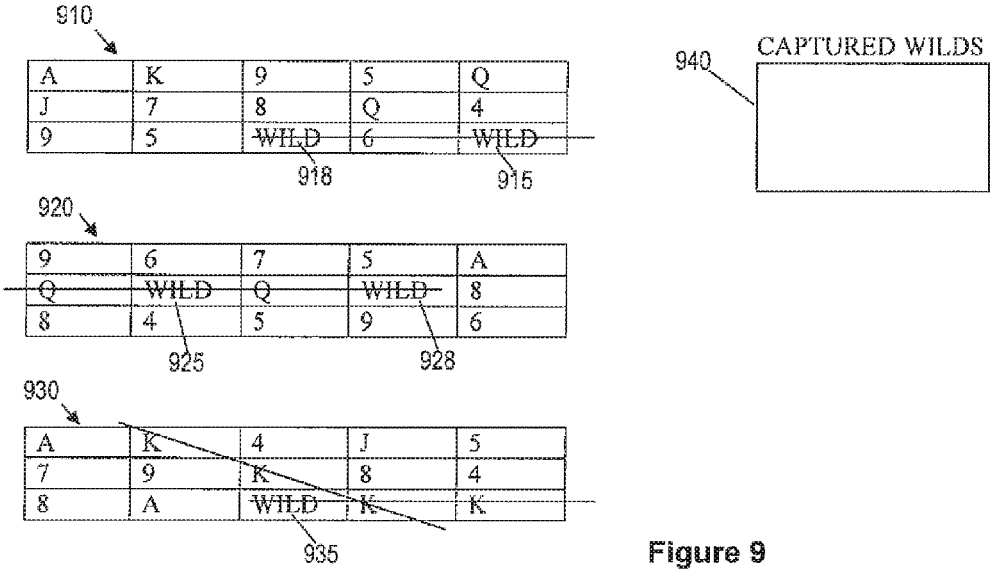
FIG. 9 is an example of further game outcomes displayed during game play.

The new game outcomes 910, 920, 930 are shown in FIG. 9. Note the "Captured WILD" display 940 is now clear as all the WILD symbol occurrences counted have now been allocated to gaming machines. In this embodiment the position for the WILD symbols in the new game outcomes is automatically determined by the outcome modifier to provide the best combination of prize winning symbol combinations, if possible. It should be appreciated that it may not be possible to always derive a winning symbol combination using a WILD symbol.

In new game outcome 910 the release WILD symbol 918 is placed to enable a winning symbol combination of 3 Q symbols. The WILD symbol 915 that occurred in the original game outcome remains in place. In some embodiments WILD symbols occurring in the original game outcome can contribute to a wining symbol combination in the new game outcome. For example, new game outcome 920 includes a winning symbol combination equivalent to four Q symbols, comprising two Q and 2 WILD symbols, one WILD 925 as originally occurred in the game outcome and one released WILD symbol 928. The WILD symbol 935 allocated to the final gaming machine results in the new game outcome 930 having two sets of three K symbols.

Awards are determined based on the winning combinations in the new game outcomes can be paid as bonus prizes, independent of the base game, to avoid affecting the payout equations for the base game.

Further aspects of the method will be apparent from the above description of the gaming system. Persons skilled in the art will also appreciate that the method could be embodied in program code. The program code could be supplied in a number of ways, for example on a computer readable medium, such as a disc or a memory (for example, that could replace part of memory 103) or as a data signal (for example, by transmitting it from a server).

Although the examples above have been described using WILD symbols as the special symbols, other symbols may be designated as special symbols. For example, scatter pay symbols, double pay symbols, or any symbols that may contribute to a winning game outcome can be designated as a special symbol. In some embodiments more than one symbol may be designated as a special symbol. Allocation of the different special symbols may use a common trigger condition or different trigger conditions may be used to trigger allocation of different special symbols.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming for use with a gaming network having linked gaming machines, each of said gaming machines being capable of generating respective game outcomes of a plurality of symbols which may include a special symbol, each of said gaming machines having a credit input mechanism configured to receive a physical item associated with a monetary value for establishing a credit balance, the credit balance being increasable and decreasable based on at least wagering activity, and a linked game controller having an accumulating counter having an accumulating counter value, the method comprising:

randomly generating game outcomes by a first plurality of the linked gaming machines in accord with having established the credit balance via the credit input mechanism of each of the first plurality of linked gaming machines receiving the physical item;

monitoring the game outcomes generated by said first plurality of linked gaming machines, said monitoring including communicating data associated with said generated game outcomes of the first plurality of linked gaming machines to said linked game controller;

identifying, via the linked game controller, a number of instances of the special symbols occurring in each of the generated game outcomes;

incrementing, via the linked game controller, said accumulating counter value of said accumulating counter in response to the identified number of instances of the special symbol occurring in the generated game outcomes of said first plurality of linked gaming machines;

displaying on a display a representation of said accumulating counter value;

determining whether a trigger condition is met;

and in response to said determining that a trigger condition is met:

allocating, via the linked game controller, at least one said special symbol to each of a second plurality of said first plurality of the linked gaming machines based on said accumulating counter value of said accumulating counter; and generating a new game outcome for each of said second plurality of said first plurality of the linked gaming machines using said at least one said special symbol that has been allocated.

2. A method as claimed in claim 1, wherein the displayed representation comprises a plurality of graphical images, wherein the number of displayed graphical images correspond to the accumulating counter value.

3. A method as claimed in claim 2, wherein the displayed graphical images correspond to WILD symbols.

4. A method as claimed in claim 1, wherein the displayed representation is a numerical counter.

5. A method as claimed in claim 1, wherein the step of displaying comprises displaying a representation of the accumulating counter value on a central display that is separate from the gaming machines.

6. A method as claimed in claim 1, wherein the step of displaying comprises displaying a representation of the accumulating counter value on displays of the respective gaming machines.

7. A method as claimed in claim 1, further comprising displaying a representation of a status of the trigger condition on a display.

8. A method as claimed in claim 7, further comprising displaying a time within which a specified game outcome must occur at one or more of the linked gaming machines.

9. A method as claimed in claim 8, wherein said game outcome comprises a specified symbol combination.

10. A gaming system as claimed in claim 1, wherein the display comprises displays at each of the gaming machines.

11. A gaming system as claimed in claim 1, wherein the display is further configured to display a representation of a status of the trigger condition.

12. A gaming system as claimed in claim 11, wherein the display is configured to displaying a time within which a specified game outcome must occur at one or more of the linked gaming machines.

13. A method as claimed in claim 12, wherein the game outcome comprises a specified symbol combination.

14. A linked game controller for use with a gaming network having linked gaming machines and a display, each of which being capable of generating respective game outcomes of a plurality of symbols which may include a special symbol, each of said gaming machines having a credit input mechanism configured to receive a physical item associated with a monetary value for establishing a credit balance, the credit balance being increasable and decreasable based on at least the wagering activity, the linked game controller comprising:

an accumulating counter having an accumulating counter value;

a game outcome monitor configured to monitor game outcomes generated at said plurality of linked gaming machines in accord with having established the credit balance via the credit input mechanism of each of the plurality of linked gaming machines receiving the physical item and identify a number of instances of the special symbol occurring in each of the generated game outcomes of the plurality of linked gaming machines;

a trigger monitor configured to determine when a trigger condition is met;

a special symbol controller configured to increment said accumulating counter value of said accumulating counter in response to the identified number of instances of the special symbol occurring in the generated game outcomes of said plurality of linked gaming machines, and in response to said trigger condition being met, allocate at least one said special symbol to each of a plurality of linked gaming machines based on said accumulating counter value of said accumulating counter;

a display controller configured to display a representation of said accumulating counter value on said display; and an outcome modifier configured to generate a new game outcome for each of said plurality of the linked gaming machines using said at least one said special symbol that has been allocated.

15. A linked game controller as claimed in claim 14, wherein the displayed representation comprises a plurality of graphical images, wherein the number of displayed graphical images correspond to the accumulating counter value.

16. A linked gaming controller as claimed in claim 14, wherein the displayed representation comprises a numerical counter.

17. A linked gaming controller as claimed in claim 14, wherein the display controller is further configured to display a representation of a status of the trigger condition on a display.

18. A linked gaming controller as claimed in claim 17, wherein the display controller is configured to display a time within which a specified a game outcome must occur at one or more of the linked gaming machines.

19. A linked gaming controller as claimed in claim 18, wherein the game outcome comprises a specified symbol combination.

20. A gaming system comprising:

a plurality of linked gaming machines being capable of generating respective game outcomes of a plurality of symbols which may include a special symbol, each of said gaming machines having a credit input mechanism configured to receive a physical item associated with a monetary value for establishing a credit balance, the credit balance being increasable and decreasable based on at least the wagering activity; and a linked game controller comprising:

an accumulating counter located independent of said plurality of gaming machines and having an accumulating counter value;

a game outcome monitor configured to monitor game outcomes generated at said plurality of linked gaming machines in accord with having established the credit balance via the credit input mechanism of each of the plurality of linked gaming machines receiving the physical item and identify a number of instances of the special symbol occurring in each of the generated game outcomes of the plurality of linked gaming machines;

a trigger monitor configured to determine when a trigger condition is met;

a special symbol controller configured to increment said accumulating counter value of said accumulating counter in response to the identified number of instances of the special symbol occurring in the generated game outcomes, and in response to said trigger condition being met, allocate at least one said special symbol to each of a plurality of linked gaming machines based on said accumulating counter value of said accumulating counter; and an outcome modifier configure to generate a new game outcome for each of said plurality of the linked gaming machines using to which said at least one special symbol that has been allocated; and a display configured to display a representation of said accumulating counter value.

21. A gaming system as claimed in claim 20, wherein the displayed representation comprises a plurality of graphical images, wherein the number of displayed graphical images correspond to the accumulating counter value.

22. A gaming system as claimed in claim 21, wherein the displayed graphical images correspond to WILD symbols.

23. A gaming system as claimed in claim 20, wherein the displayed representation is a numerical counter.

24. A gaming system as claimed in claim 20, wherein the display comprises a central display that is separate from the gaming machines.

* * * * *